US007152773B2

(12) United States Patent
Ke

(10) Patent No.: US 7,152,773 B2
(45) Date of Patent: Dec. 26, 2006

(54) TRIGGER SELECTOR FOR A NAIL GUN

(75) Inventor: Chih-Chine Ke, Tali (TW)

(73) Assignee: Rexon Industrial Corp., Ltd., Tali (TW)

( * ) Notice: Subject to any disclaimer, the term of this patent is extended or adjusted under 35 U.S.C. 154(b) by 0 days.

(21) Appl. No.: 11/089,791

(22) Filed: Mar. 23, 2005

(65) Prior Publication Data

US 2006/0213945 A1 Sep. 28, 2006

(51) Int. Cl.
*B25C 1/04* (2006.01)

(52) U.S. Cl. ..... 227/8; 227/130

(58) Field of Classification Search ..... 227/8, 227/10, 130, 142, 156; 173/170
See application file for complete search history.

(56) References Cited

U.S. PATENT DOCUMENTS 5,219,110 A * 6/1993 Mukoyama ..... 227/8
5,593,079 A * 1/1997 Mukoyama et al. ..... 227/8
5,715,982 A * 2/1998 Adachi ..... 227/8
5,785,227 A * 7/1998 Akiba ..... 227/8
6,929,165 B1 * 8/2005 Chen et al. ..... 227/8
6,948,646 B1 * 9/2005 Huang ..... 227/8
6,953,137 B1 * 10/2005 Nakano et al. ..... 227/8
7,004,367 B1 * 2/2006 Shen et al. ..... 227/8

* cited by examiner

*Primary Examiner*—Scott A. Smith
(74) *Attorney, Agent, or Firm*—patenttm.us; James H. Walters

(57) ABSTRACT

A trigger selector is used with a nail gun. The nail gun has a body and a safety. The body has a casing, a handgrip, an air passage and a valve. The trigger selector has a trigger, a selector sleeve, an enabling lever and a pin. The trigger has a recess and two slots. The selector sleeve is mounted slidably on the trigger and has two mounting holes corresponding to the slots in the trigger. The enabling lever is mounted pivotally in the recess, extends from the open top of the trigger, selectively aligns with the safety and aligns with the valve. The nail gun is adjusted a single shot or a semiautomatic mode by sliding the selector sleeve relative to the trigger.

6 Claims, 12 Drawing Sheets

TRIGGER SELECTOR FOR A NAIL GUN

BACKGROUND OF THE INVENTION

1. Field of the Invention

The present invention relates to a nail gun, and more particularly to a trigger selector for a nail gun that has a simple structure and adjusts single or continuous shooting of the nail gun.

2. Description of Related Art

A conventional nail gun comprises a body, a safety, a trigger and a magazine.

The body has a casing, a handgrip, an air passage and a valve. The casing has a front end, a rear end and a bottom. The handgrip is formed on and extends perpendicularly down from the bottom of the casing and has a front and a bottom end. The air passage is defined through the body. The valve is mounted in front of the handgrip and selectively admits compressed air into the air passage.

The safety is slidably mounted on the front end of the casing and has a front foot and an activation rod having a rear end.

The trigger is mounted on the bottom of the casing in front of the handgrip between the rear end of the activation rod and the valve.

The magazine is mounted detachably on the front end of the casing and holds multiple nails.

The nail gun is used with an air compressor containing compressed air supplied to the air passage. When shooting a nail into a workpiece such as wood, the front foot is pressed manually against the workpiece, and the activation rod slides back and enables the trigger. When the trigger is squeezed manually against the front of the handle, the valve is triggered to release a burst of compressed air into the air passage. The compressed air smoothly passes through the air passage and projects a nail into the workpiece.

However, each shooting of the nail gun requires both manual operations of pressing the safety and squeezing the trigger. Therefore, the operation of the nail gun can be very inconvenient when many nails must be driven into an object.

A selector switch has been developed for the nail gun to allow a user to choose a single shot or semiautomatic mode of operation of the nail gun. The selector switch is mounted rotatably on the casing of the nail gun, connects to the trigger and selectively moves the trigger to one of two different positions so the nail gun operates respectively in a single shot or semiautomatic mode. In the semiautomatic mode, the trigger is pressed and held against the handgrip so pressing the foot of the safety against a workpiece automatically shoots a nail. However, the selector switch has an intricate structure, and the nail gun must be modified substantially to accommodate to the selector switch. Therefore, the nail gun is hard to assemble.

To overcome the shortcomings, the present invention provides a trigger selector for a nail gun to mitigate or obviate the aforementioned problems.

SUMMARY OF THE INVENTION

The main objective of the invention is to provide a trigger selector for a nail gun that has a simple structure and enables a single shot or semiautomatic mode of the nail gun.

A trigger selector in accordance with the present invention is used with a nail gun. The nail gun has a body and a safety. The body has a casing, a handgrip, an air passage and a valve.

The trigger selector has a trigger, a selector sleeve, an enabling lever and a pin. The trigger has a recess, two slots and an open top. The selector sleeve is mounted slidably on the trigger and has two holes corresponding to the slots in the trigger. The enabling lever is mounted pivotally in the recess and extends from the open top of the trigger and corresponds to the safety and the valve.

Other objectives, advantages and novel features of the invention will become more apparent from the following detailed description when taken in conjunction with the accompanying drawings.

DETAILED DESCRIPTION OF PREFERRED EMBODIMENT

Figure 1:
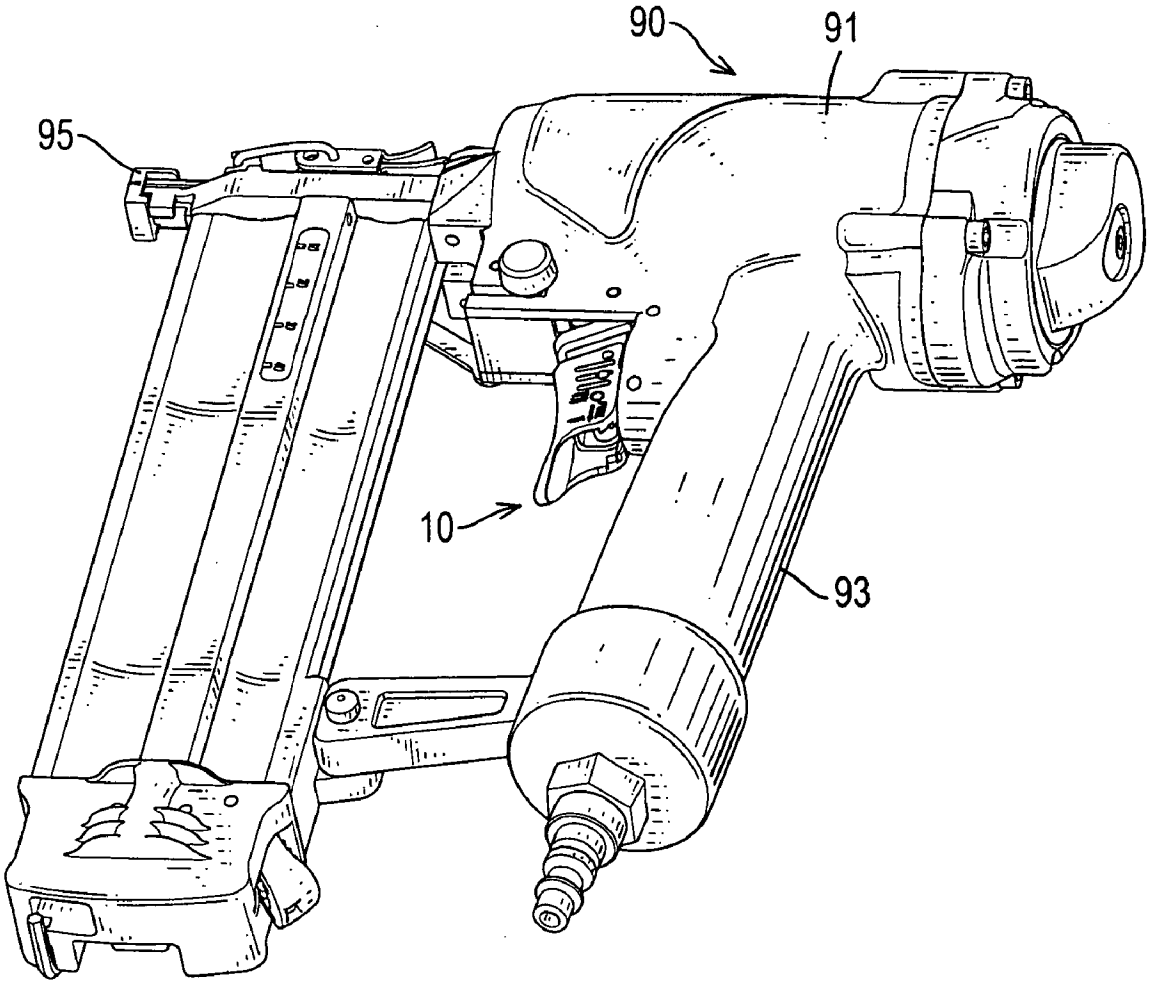
FIG. 1 is a perspective view of a nail gun with a trigger selector in accordance with the present invention.
Figure 4:
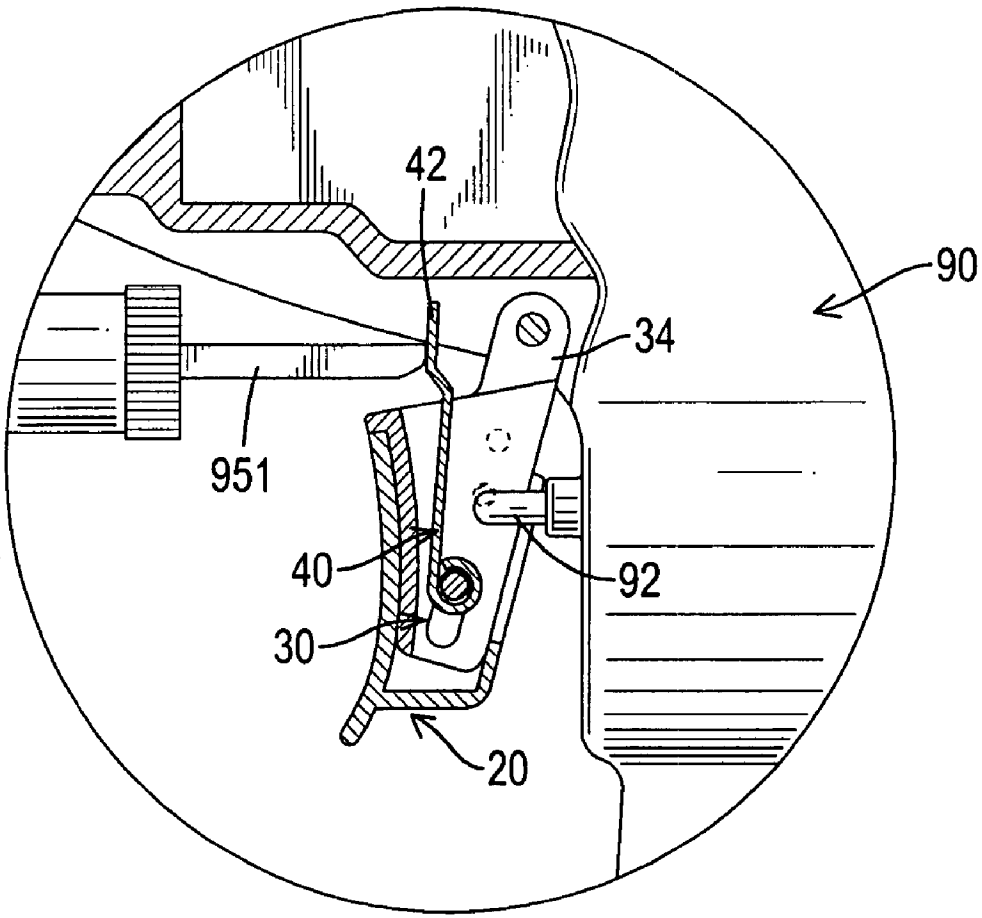
FIG. 4 is an operational side view in partial section of the trigger selector in FIG. 1 with the trigger in position to enable the semiautomatic mode.

With reference to FIGS. 1 and 4, a trigger selector (10) in accordance with the present invention is used with a nail gun (90) and comprises a trigger (30), a selector sleeve (20), an enabling lever (40) and a pin (50). The nail gun (90) has a casing (91), a safety (95), a handgrip (93), an air passage (not shown) and a valve (92). The casing (91) has a front end, a rear end and a bottom. The handgrip (93) is formed on and extends perpendicularly down from the casing (91) and has a front end. The air passage is defined through the handgrip (93) and the casing (91). The valve (92) is mounted in front of the handgrip (93) and selectively admits compressed air into the air passage when the valve (92) is pushed. The safety (95) is slidably mounted on the front end of the casing (91) and has a front foot and an activation rod (951) having a rear end.

The trigger selector (10) is mounted on the bottom of the casing (91) in front of the handgrip (93) between the rear end of the activation rod (951) and the valve (92).

Figure 2:
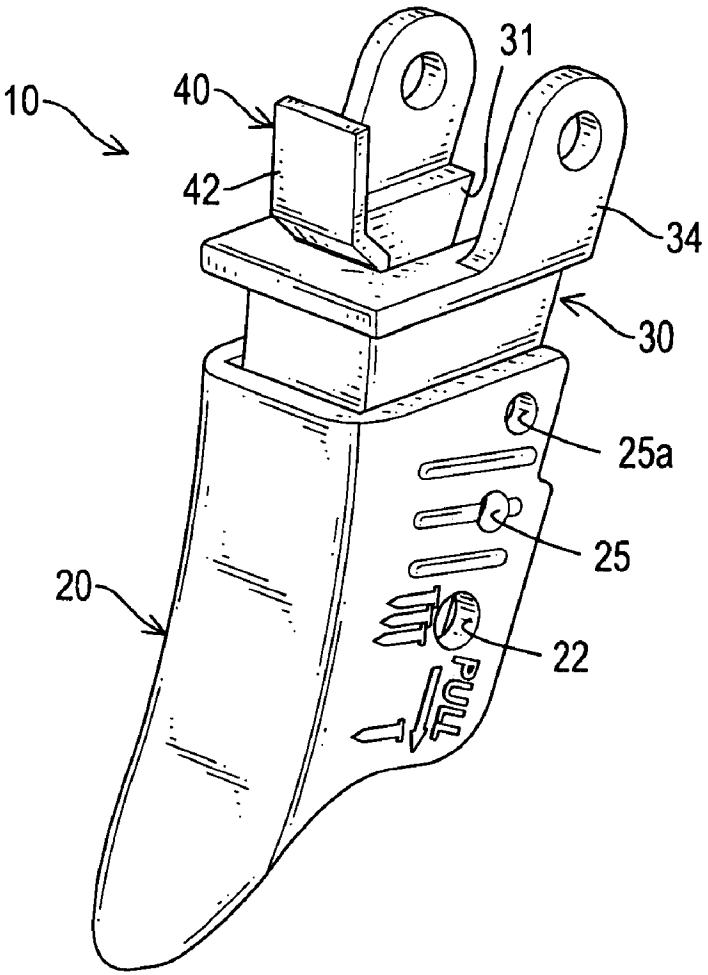
FIG. 2 is a perspective view of the trigger selector in FIG. 1.
Figure 3:
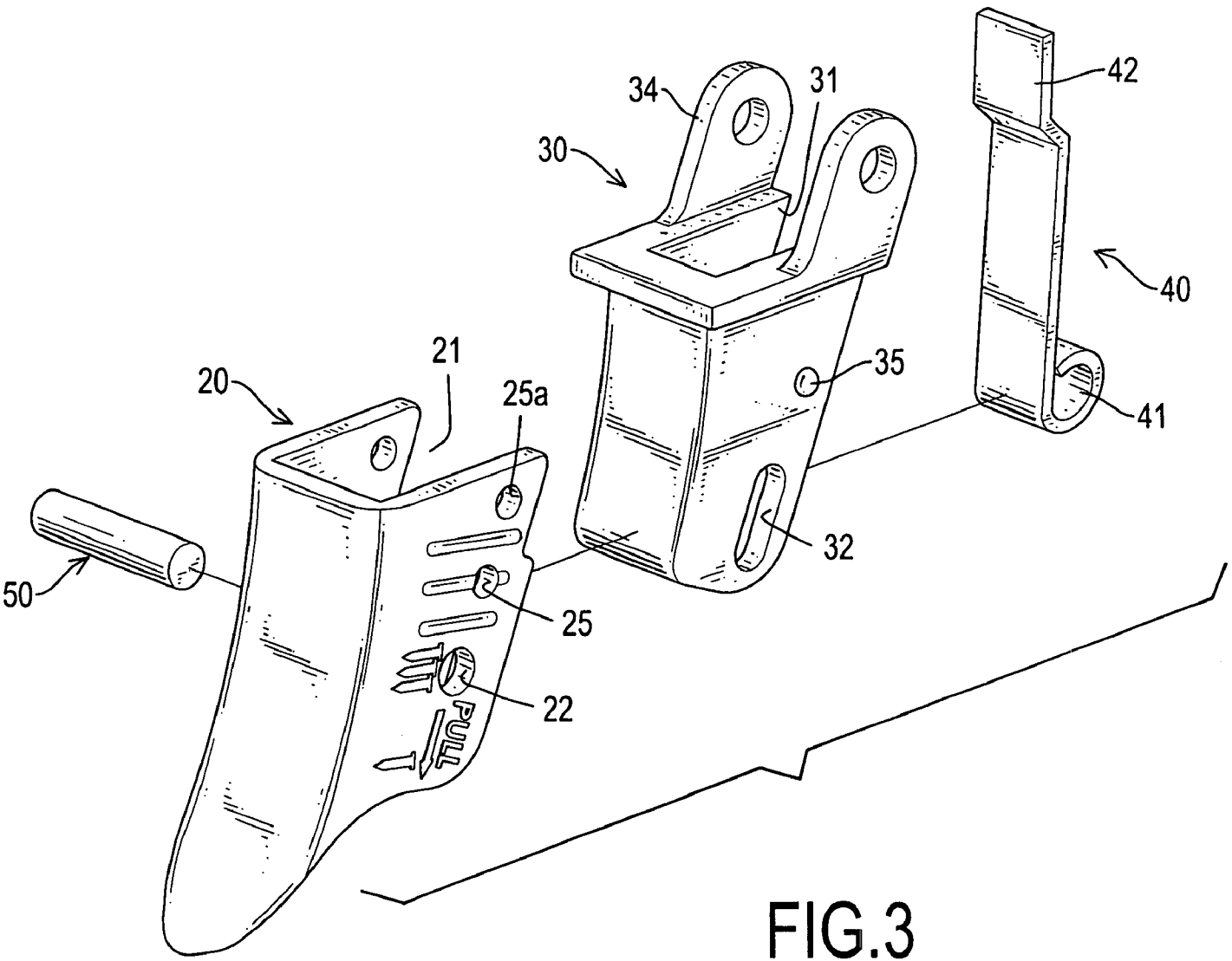
FIG. 3 is an exploded perspective view of the trigger selector in FIG. 2.

With further reference to FIGS. 2 and 3, the trigger (30) is hollow, is attached pivotally to the bottom of the casing (91) and has a front, an open rear, an open top, two opposite sides, a recess (31), two longitudinal slots (32), two ears (34) and two protrusions (35). Each side has an outside surface.

The recess (31) is defined in the trigger (30) and communicates with the open top and the open rear. The longitudinal slots (32) are defined respectively through the sides of the trigger (30) and communicate with the recess (31). The ears (34) are formed respectively on the sides at the open top and are attached pivotally to the bottom of the casing (91) in front of the handgrip (93). Each ear (34) has a mounting hole defined through the ear (34). The protrusions (35) are formed respectively on the outside surfaces of sides between the longitudinal slot (32) and the open top.

The selector sleeve (20) is hollow, is mounted slidably on the trigger (30) and has a front, an open rear, an open top, two opposite sides, a recess (21), two mounting holes (22), two lower bores (25) and two upper bores (25*a*). The recess (21) is defined in the selector sleeve (20), communicates with the open top and the open rear and allows the trigger (30) to extend in the recess (21). The mounting holes (22) are defined respectively through the sides of the selector sleeve (20), correspond to the longitudinal slots (32) in the trigger (30) and communicate with the recess (21) in the selector sleeve (20). The lower bores (25) are defined respectively through the sides. The upper bores (25*a*) are defined respectively through the sides above the lower bores (25).

The enabling lever (40) is mounted pivotally in the recess (31) of the trigger (30), extends from the open top of the trigger (30), aligns with the valve (92), selectively aligns with the activation rod (951) and has a top end, an offset bottom end, a pivot hole (41) and a contact tab (42). The pivot hole (41) is defined through the offset bottom end. The contact tab (42) is formed at the top end and has a top end.

Figure 8:
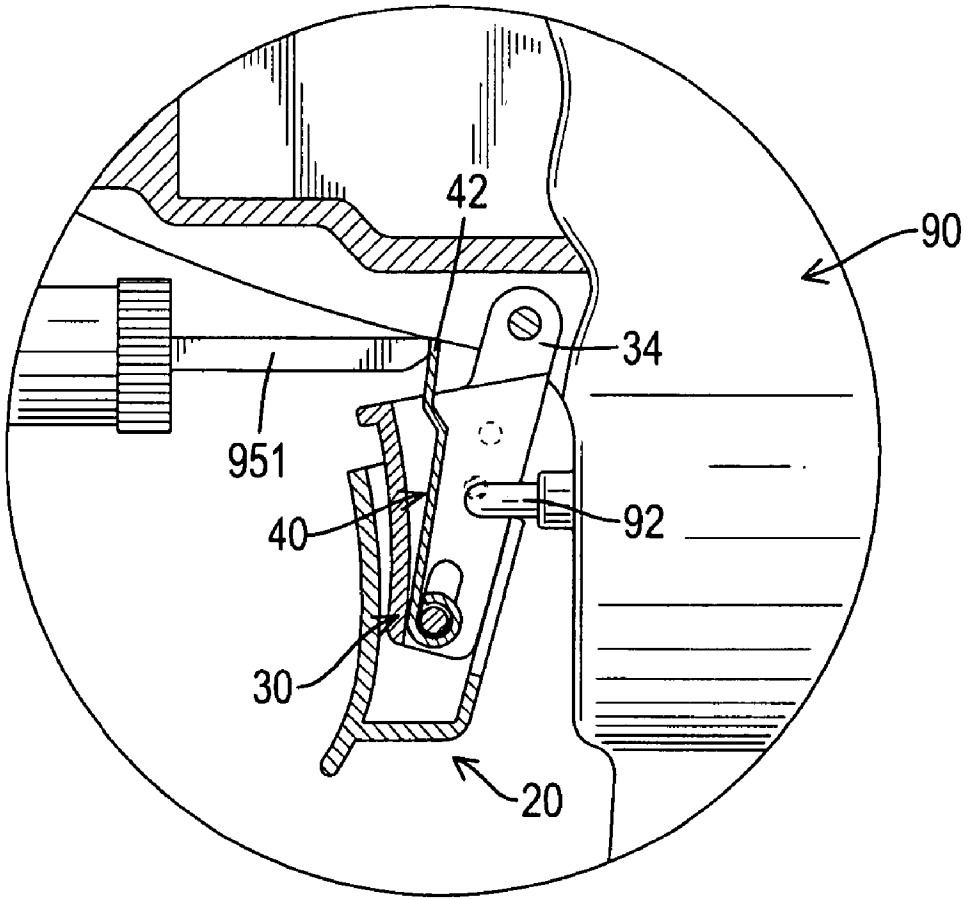
FIG. 8 is an operational side view in partial section of the trigger selector in FIG. 1 with the trigger selector in FIG. 1 in position to enable the single shot mode.

The pin (50) is mounted through the mounting holes (22) in the selector sleeve (20), the longitudinal slots (32) in the trigger (30) and the pivot hole (41) in the enabling lever (40). With reference to FIGS. 4 and 8, the pin (50) and enabling lever (40) move with the selector sleeve (20) along the longitudinal slots (32) in the trigger (30) when the selector sleeve (20) slides relative to the trigger (30).

The trigger selector (10) places the nail gun (90) in semiautomatic mode by sliding the selector sleeve (20) upward until the protrusions (35) on the trigger (30) seat in the lower bores (25) in the selector sleeve (20). The contact tab (42) aligns with the rear end of the activation rod (951).

Figure 5:
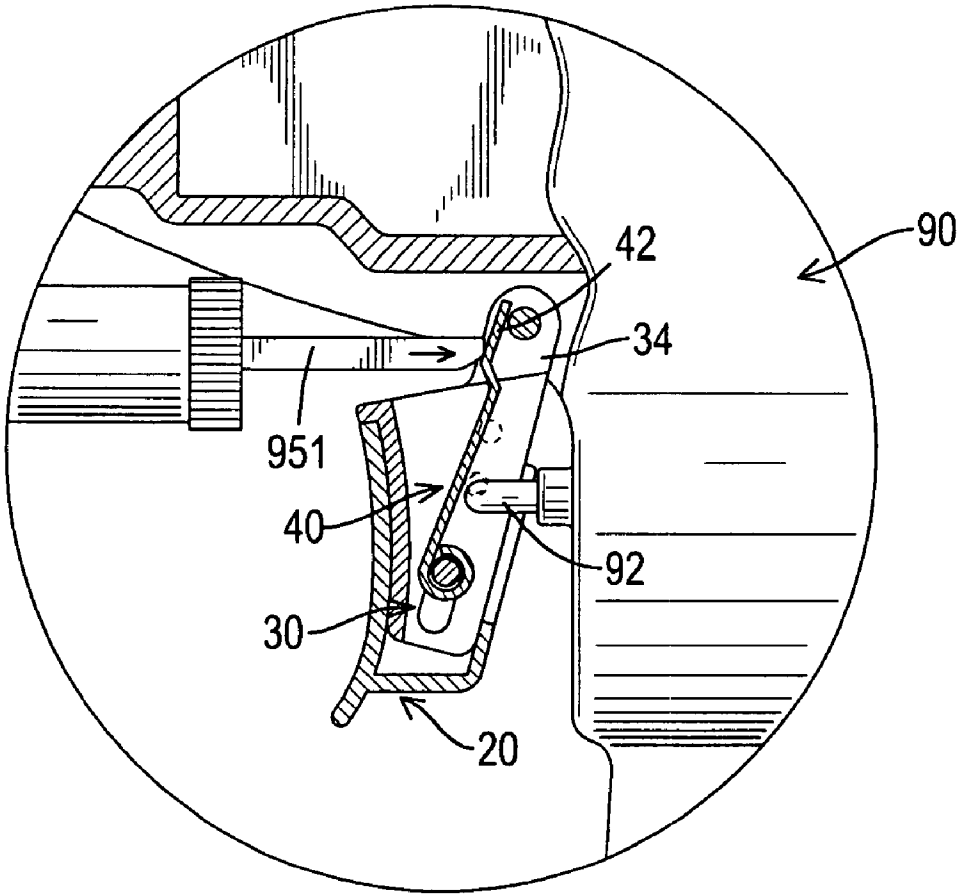
FIG. 5 is an operational side view in partial section of the foot initially enabling the trigger in FIG. 4.

With reference to FIG. 5, the nail gun (90) is fired in the semiautomatic mode by pressing the safety (95) against a workpiece such as a piece of wood so the rear end of the activation rod (951) pushes the contact tab (42) and the enabling lever (40) against the valve (92).

Figure 6:
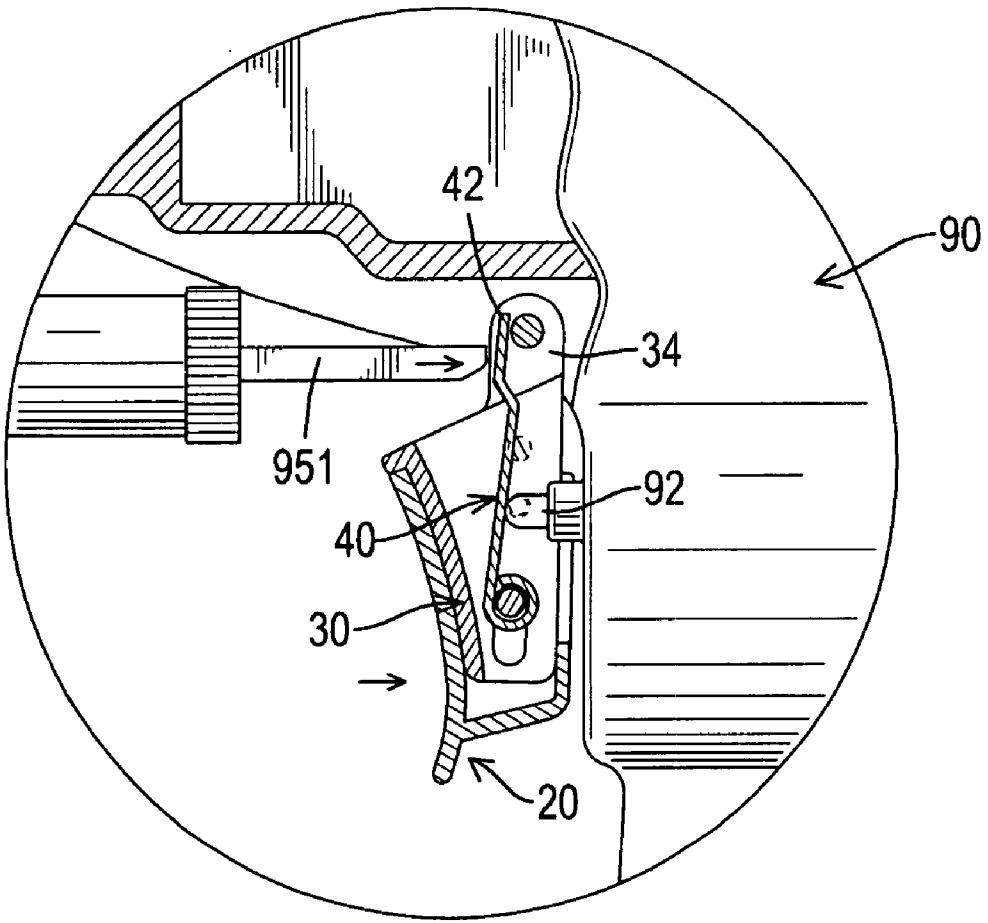
FIG. 6 is an operational side view in partial section of the trigger firing a nail in FIG. 5.

With reference to FIG. 6, squeezing the trigger (30) and the selector sleeve (20) causes the enabling lever (40) to press the valve (92) and shoot a nail. Subsequent nails are fired without releasing the trigger (30).

Figure 7:
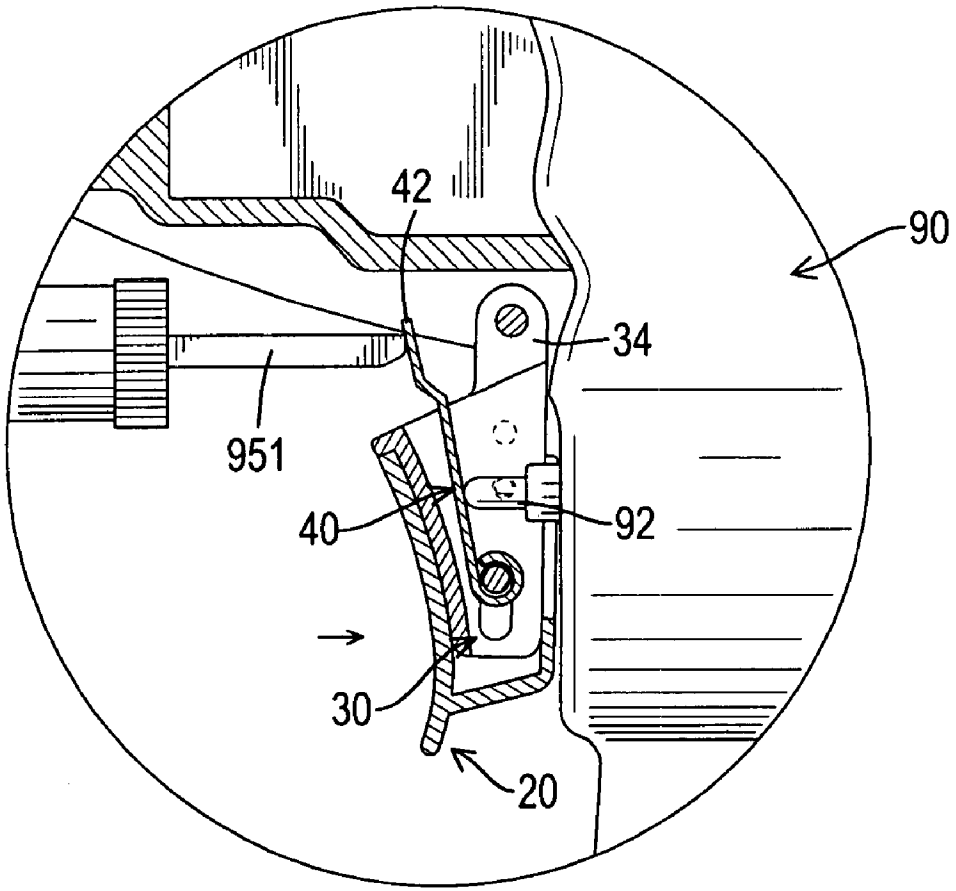
FIG. 7 is an operational side view in partial section of the trigger selector in FIG. 6 with the foot resetting the valve.

With reference to FIG. 7, subsequent nails are fired in the semiautomatic mode by removing the safety (95) from the workpiece while holding the trigger (30) and selector sleeve (20) in position. The activation rod (951) moves forward, which allows the enabling lever (40) to pivot forward and resets the valve (92). The top end of the contact tab (42) continues to be aligned with the rear end of the activation rod (951) so another nail can be fired by simply pressing the safety (95) against a workpiece.

With reference to FIG. 8, the single shot mode is selected on the nail gun (90) with the trigger selector (10) by sliding the selector sleeve (20) downward until the protrusions (35) on the trigger (30) seat in the upper bores (25*a*) of the selector sleeve (20). The top end of the contact tab (42) aligns with the rear end of the activation rod (951).

Figure 9:
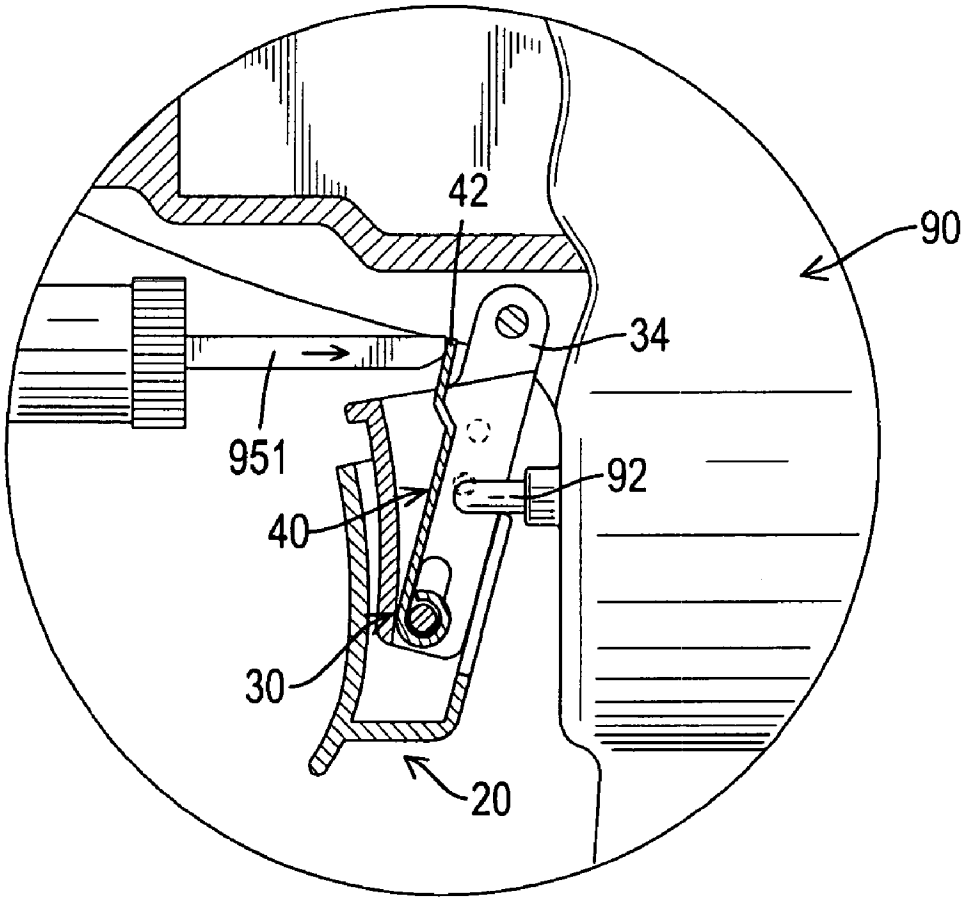
FIG. 9 is an operational side view in partial section of the foot enabling the trigger in FIG. 8.

With reference to FIG. 9, the nail gun (90) is fired in the single shot mode by pressing the safety (95) against a workpiece such as a piece of wood so the rear end of the activation rod (951) pushes the top end of the contact tab (42).

Figure 10:
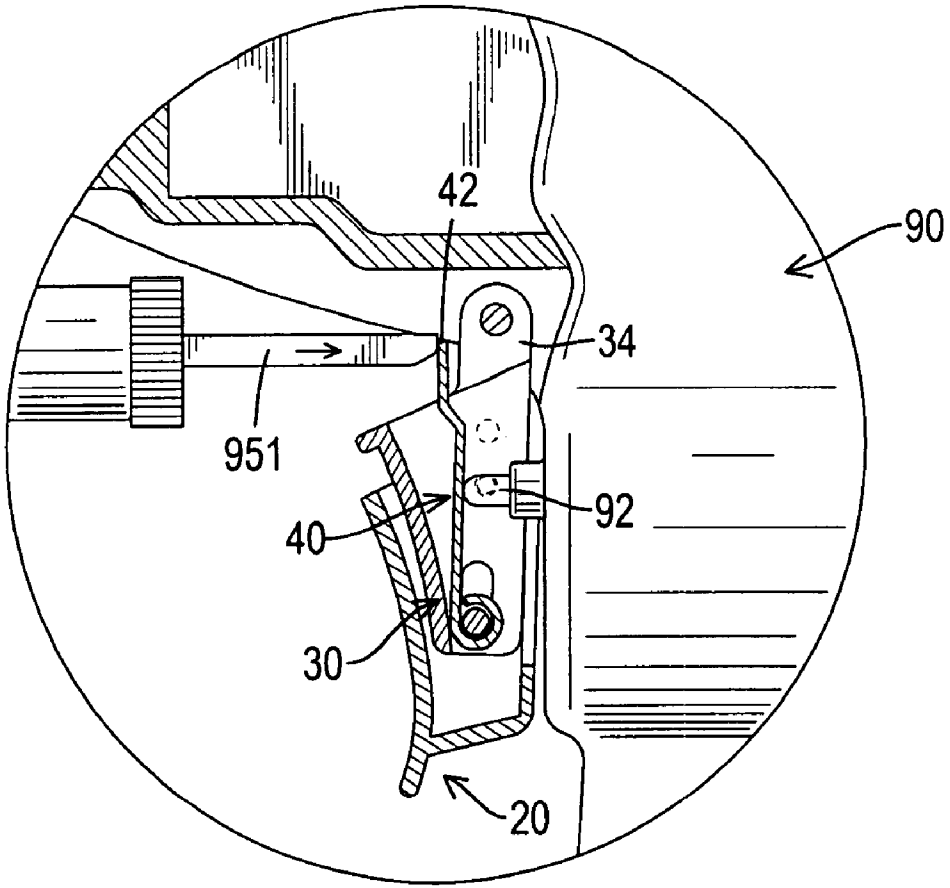
FIG. 10 is an operational side view in partial section of the trigger firing a nail in FIG. 9.

With reference to FIG. 10, squeezing the trigger (30) and the selector sleeve (20) causes the enabling lever (40) to press the valve (92) and shoot a nail.

Figure 11:
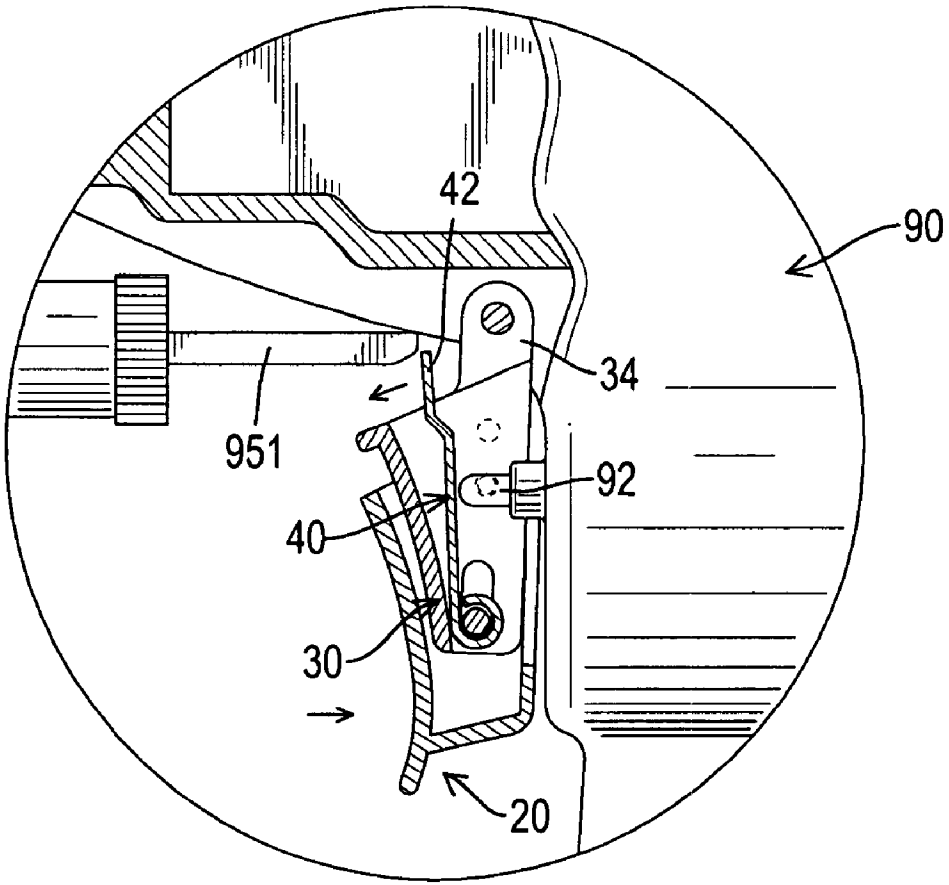
FIG. 11 is an operational side view in partial section of the trigger being disabled after firing a nail in FIG. 10.

With reference to FIG. 11, continuing to squeeze the trigger (30) and selector sleeve (20) against the handgrip (93) causes the top end of the top end of the contact tab (42) releases from the rear end of the activation rod (951).

Figure 12:
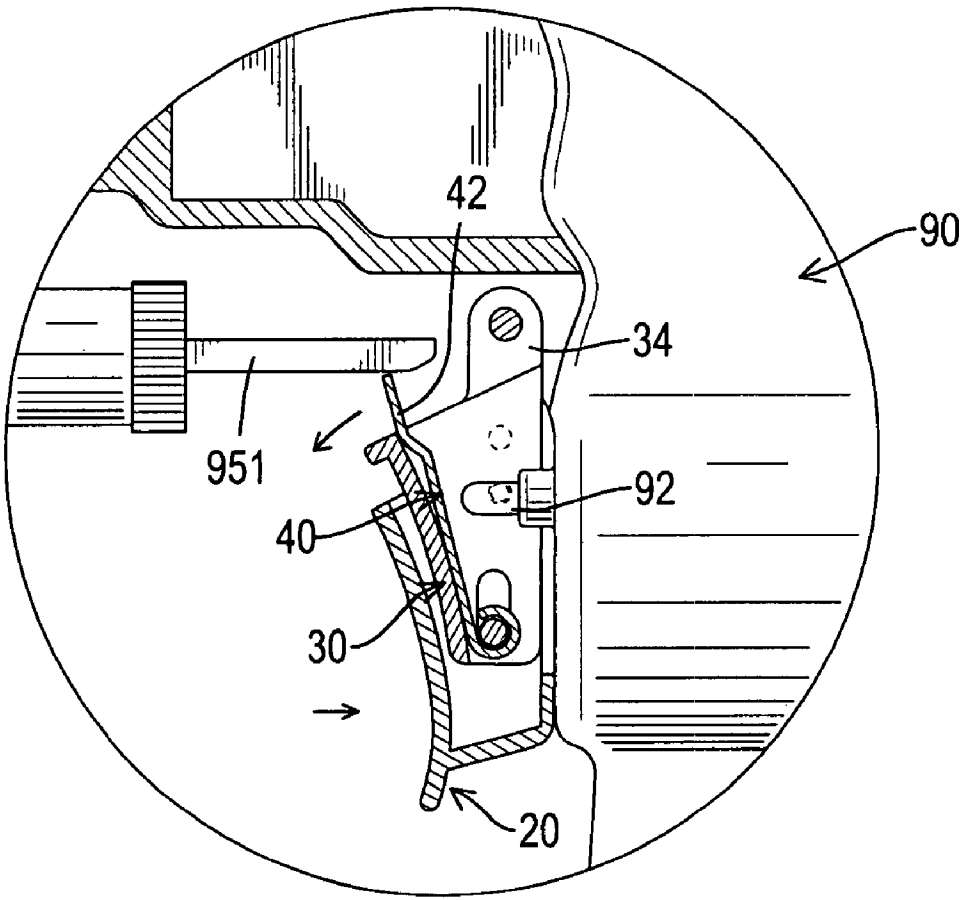
FIG. 12 is an operational side view in partial section of the trigger in FIG. 11 completely disabled after firing a nail.

With reference to FIG. 12, the top end of the contact tab (42) is held under the activation rod (951) until the safety (95) is removed from the workpiece. When the safety (95) is removed from the workpiece, the activation rod (951) moves forward and allows the top end of the contact tab (42) to realign with the activation rod (951) only when the trigger (30) is released. To shoot another nail, the safety (95) is pressed against the workpiece and the trigger (30) is squeezed.

The operation of the trigger selector (10) is simple and convenient. Furthermore, the structure of the trigger selector is simple and installation of the trigger selector on a nail gun requires very little modification of the nail gun.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A trigger selector for a nail gun comprising:

a trigger being hollow, attached pivotally to the nail gun and having a front;

an open rear;

an open top;

two opposite sides, each having an outside surface;

a first recess defined in the trigger and communicating with the open top and the open rear; and two longitudinal slots defined respectively through the sides of the trigger and communicating with the recess;

a selector sleeve being hollow, mounted slidably on the trigger and having a front;

an open rear;

an open top;

two opposite sides;

a second recess defined in the selector sleeve, communicating with the open top and the open rear and allowing the trigger to extend therein; and two mounting holes defined respectively through the sides of the selector sleeve, corresponding to the longitudinal slots in the trigger and communicating with the second recess of the selector sleeve;

an enabling lever mounted pivotally in the first recess of the trigger, extending in the first recess and through the open top of the trigger and having a top end, a offset bottom end, a pivot hole defined through the offset bottom end and a contact tab formed on the top end; and a pin mounted through the mounting holes in the selector sleeve, the longitudinal slots in the trigger and the pivot hole in the enabling lever;

when the selector sleeve slides relative to the trigger, the pin and enabling lever move with the selector sleeve along the longitudinal slots in the trigger.

2. The trigger selector as claimed in claim 1, wherein:

the trigger further has two protrusions respectively formed on the outside surfaces of the trigger; and the selector sleeve further has two lower bores defined respectively through the sides of the selector sleeve and selectively engaging with the protrusions of the trigger; and two upper bores defined respectively through the sides of the selector sleeve above the lower bores and selectively engaging with the protrusions of the trigger.

3. The trigger selector as claimed in claim 2, wherein the trigger further has two ears connected respectively to the sides of the trigger on the open top for connecting pivotally to the nail gun, and each ear has a mounting hole defined through the ear.

4. The trigger selector as claimed in claim 2, wherein the protrusions are between the longitudinal slot and the open top of the trigger.

5. A trigger selector for a nail gun comprising:

a trigger being hollow, attached pivotally to the nail gun and having a front;

an open rear;

an open top;

two opposite sides each having an outside surface;

a first recess defined in the trigger and communicating with the open top and the open rear;

two longitudinal slots defined respectively through the sides of the trigger and communicating with the recess; and two protrusions respectively formed on the outside surfaces of the sides of the trigger;

a selector sleeve being hollow, mounted slidably on the trigger and having a front;

an open rear;

an open top;

two opposite sides;

a second recess defined in the selector sleeve, communicating with the open top and the open rear and allowing the trigger to extend therein;

two mounting holes defined respectively through the sides of the selector sleeve, corresponding to the longitudinal slots in the trigger and communicating with the second recess in the selector sleeve;

two lower bores defined respectively through the sides of the selector sleeve and selectively engaging with the protrusions of the trigger; and two upper bores defined respectively through the sides above the lower bores of the selector sleeve and selectively engaging with the protrusions of the trigger;

an enabling lever mounted pivotally in the first recess of the trigger, extending in the first recess and through the open top of the trigger and having a top end, a offset bottom end, a pivot hole defined through the offset bottom end and a contact tab formed on the top end; and a pin mounted through the mounting holes in the selector sleeve, the longitudinal slots in the trigger and the pivot hole in the enabling lever;

when the selector sleeve slides relative to the trigger, the pin and enabling lever move with the selector sleeve along the longitudinal slots in the trigger.

6. A trigger selector for a nail gun comprising:

a trigger being hollow, attached pivotally to the nail gun and having a front;

an open rear;

an open top;

two opposite sides each having an outside surface;

a first recess defined in the trigger and communicating with the open top and the open rear;

two longitudinal slots defined respectively through the sides of the trigger and communicating with the recess; and two ears connected respectively to the sides of the trigger on the open top for connecting pivotally to the nail gun, and each ear having a mounting hole defined through the ear;

a selector sleeve being hollow, mounted slidably on the trigger and having a front;

an open rear;

an open top;

two opposite sides;

a second recess defined in the selector sleeve, communicating with the open top and the open rear and allowing the trigger to extend therein; and two mounting holes defined respectively through the sides of the selector sleeve, corresponding to the longitudinal slots in the trigger and communicating with the second recess in the selector sleeve;

an enabling lever mounted pivotally in the first recess of the trigger, extending in the first recess and through the open top of the trigger and having a top end, a offset bottom end, a pivot hole defined through the offset bottom end and a contact tab formed on the top end; and a pin mounted through the mounting holes in the selector sleeve, the longitudinal slots in the trigger and the pivot hole in the enabling lever;

when the selector sleeve slides relative to the trigger, the pin and enabling lever move with the selector sleeve along the longitudinal slots in the trigger.

* * * * *